United States Patent [19]

Oyama et al.

[11] 4,173,406

[45] Nov. 6, 1979

[54] ELECTRICAL CHARGE REMOVING ARRANGEMENT FOR REMOVING CHARGE FROM NON-IMAGE BEARING PORTIONS OF PHOTO-SENSITIVE MEDIUM

[75] Inventors: Kenjiro Oyama, Toyokawa; Koji Imaizumi, Aichi, both of Japan

[73] Assignee: Minolta Camera Kabushiki Kaisha, Osaka, Japan

[21] Appl. No.: 892,862

[22] Filed: Mar. 31, 1978

[30] Foreign Application Priority Data

Apr. 22, 1977 [JP] Japan ..... 52-46965

[51] Int. Cl.[2] ..... G03G 15/00

[52] U.S. Cl. ..... 355/3 R; 355/1; 355/7; 355/71

[58] Field of Search ..... 355/3 R, 7, 11, 14, 355/16, 71, 1, 133

[56] References Cited

U.S. PATENT DOCUMENTS

| | | | |
|---|---|---|---|
| 3,724,942 | 4/1973 | Gibsoa et al. | 355/8 X |
| 3,788,737 | 1/1974 | Kidd | 355/7 X |

OTHER PUBLICATIONS

*Xerox Disclosure Journal,* Available Light Marginal Illumination System, vol. 2, No. 5, Sep. '77, pp. 103, 104.

*Primary Examiner*—R. L. Moses

*Attorney, Agent, or Firm*—Wenderoth, Lind & Ponack

[57] ABSTRACT

The invention is directed to an arrangement for removal of electrical charge from non-image bearing portions of a photosensitive medium in a photocopying machine, in which radiation of light for removal of electrical charge from portions of the medium which are not required for production of an image, when photocopies at reduced magnification are produced, for example, is made the same as or closely similar to the intensity of light for effecting production of an image, whereby unwanted adhesion of developer material to the medium is avoided, and at the same time, since all portions of the medium are always exposed to generally the same intensity of radiation, characteristics of different portions of the medium are maintained constant even after prolonged use thereof.

12 Claims, 11 Drawing Figures

ELECTRICAL CHARGE REMOVING ARRANGEMENT FOR REMOVING CHARGE FROM NON-IMAGE BEARING PORTIONS OF PHOTO-SENSITIVE MEDIUM

BACKGROUND OF THE INVENTION

The present invention relates to an electrophotocopying machine and more particularly to an arrangement for removal of electrical charge from non-image-carrying portions of a photosensitive medium in an electrophotocopying machine.

In a conventional electrophotocopying machine, light reflected from an original document to be copied is directed by an exposure system onto the electrically charged surface of a photosensitive medium, the exposure system including lamp means for illuminating the original document, and the orginal document being protected from external light by an opaque cover or other means, which also permits removal of charges from peripheral portions of the photosensitive medium when a small original document it being copied. By this action, light coming from highly reflective portions of the original document which do not carry image elements causes the charge to be removed from the photosensitive medium, whereas the amount of light coming from image portions of the document, which are much less reflective, is insufficient to cause marked removal of the charge from the photosensitive medium, whereby there is defined on the photosensitive medium an electrostatic latent image constituted by charged portions corresponding to image portions of the original document and uncharged portions corresponding to non-image portions of the document. This exposure process may be effected as a flash exposure process in which the entire image of the original document is directed onto the surface of the photosensitive medium at once, or as a scanning process in which light from successive portions of the original document is directed onto successive portions of a moving photosensitive medium. Subsequent to exposure, development of the electrostatic latent image carried by the photosensitive medium is effected by applying, for example, resinous toner particles onto the image-carrying portion of the photosensitive medium, these particles adhering to charged portions of the photosensitive medium, but not to uncharged portions thereof, thus defining a pattern corresponding to the content of the original document. This toner pattern is subsequently transferred from the photosensitive medium onto a sheet of copy paper, for example, after which the pattern is fixed on the copy paper, which is then discharged to the exterior of the photocopying machine, and remnant toner particles are removed from the photosensitive medium by suitable cleaning means, while any remnant charge is also removed from the photosensitive medium in order to permit even charging or light exposure thereof prior to the next exposure process.

The exposure system and associated elements of a photocopying machine are designed to permit exposure of an area of the photosensitive medium of a set size corresponding to the size of a sheet of copy paper, or, in the case of a photocopying machine permitting production of photocopies at different magnifications, exposure of two or three areas of particular set sizes, since an exposure system permitting arbitrary selection of the size of the exposed area of the photosensitive drum, in order to match the size of an original document, would be too complex for practical purposes. If the size of an original document exactly matches the size of the exposed area of the photosensitive medium, in the exposure process, charge is removed from all portions of this area which are not required for defining image elements and so no toner particles adhere to these portions in the development process, and in the photocopy subsequently obtained, the corresponding portions of the copy paper are white. However, if the area of the projected image of the original document is smaller than the set area for formation of an image on the photosensitive medium, and if this entire area of the photosensitive medium is charged prior to the exposure process and the original document is not covered by an opaque cover, peripheral portions of this area of the photosensitive medium may remain charged, resulting in undesirable adhesion of toner particles to the photosensitive medium and production of an undesirable border around the information-carrying portion of a subsequently obtained photocopy. If the sheet of copy paper is smaller than the image-carrying portion of the photosensitive medium, a great amount of toner particles remains adhered to the photosensitive medium, thus imposing considerable burden on the above-noted cleaning means for removal of toner particles. This problem inevitably occurs in a photocopying machine for production of photocopies at different magnifications, as shown in FIG. 1.

In FIG. 1, there is shown a fragmentary top plan view of a known photosensitive medium or photoreceptor Ra, in which the two-dot chain line portions F1 indicate areas required for production of latent images for photocopies of equal magnification or a magnification of one, and the one-dot chain line portions F2 indicate areas required for production of latent images for photocopies of reduced magnification. Therefore, the area having width d1 between the portions F1 defines an intermediate non-latent image carrying portion in the case of equal magnification and that having width d2 between the portions F2 represents an intermediate non-latent image carrying portion for the reduced magnification. Similarly, area on each side of the photoreceptor Ra having width e1 between the side edge of the portion F1 and the corresponding side edge of the photoreceptor Ra defines side non-latent image carrying portions for equal magnification while the areas having width e2 between the side edge of the portion F2 and corresponding side edge of the photoreceptor Ra represents side non-latent image carrying portions for reduced magnification. The non-latent image carrying portions as described above are uniformly charged in a copying operation in a similar manner as in the image carrying portions, resulting in the inconveniences as described earlier. It should be noted here, however, that the intermediate non-latent image carrying portions having widths d1 and d2, and the area having width e3 equivalent to the difference between the areas having widths e1 and e2 at each side edge of the photoreceptor Ra are also used as image forming portions in many copying operations.

More specifically, the photosensitive medium portions on the sides of the area required for production of reduced magnification photocopies and intermediate portions between photosensitive medium areas for image-formation at any magnification are liable to remain charged after the exposure process. Such charge may be efficiently removed from the above-noted intermediate portions of the photosensitive medium by provision in the photocopying machine exposure system of a light transmitting element, such as described in U.S. Pat. No. 2,909,971, for direction of light onto such a portion in each exposure process. However, such a means is more particularly suited to use in a single-magnification photocopying machine, and does not resolve the problem of undesired charge remaining at the sides of the image-carrying areas of the photosensitive medium.

For overcoming the problems as described above, there has previously been proposed an arrangement, for example, as shown in U.S. Pat. No. 3,751,155, according to which charge erasure means is provided to selectively remove charge on the side portions of a photosensitive medium prior to the process of development of an electrostatic latent image carried by the photosensitive medium, this means comprising one or more selectively actuated light sources and means for directing light source or sources onto the side portions of the photosensitive medium.

However, the conventional means such as referred to above is intended simply to prevent undesired adhesion of toner particles to a photosensitive medium, and disregards the effects which are produced on characteristics of the photosensitive medium after prolonged use due to exposure of different portions thereof to different types of light. That is, referring again to FIG. 1, regardless of the size of the photocopy to be produced, the area F2 of the photosensitive medium employed for production of reduced-magnification photocopies is always exposed to the same type of light, whereas the side portions having width e3 at the side edges of the area F2 used for production of reduced-magnification photocopies and the area F1 used for production of photocopies of a magnification of one are sometimes exposed to light having a wavelength selected with reference to characteristics of the photosensitive medium to render the light sensitivity of the photosensitive medium generally equivalent to that of the human eye and sometimes to light which is simply intended to remove a charge from the photosensitive medium, with the result that characteristics of the portions F2 and of the portions having the width e3 of the photosensitive medium become different after a certain period of time, and when it is required to produce a photocopy of a magnification of one, there is a difference in image-quality in portions of the photocopy corresponding to the portions F2 and the portions with the width e3 of the photosensitive medium.

In more detail, for example, if the photosensitive medium is the so-called PVK·Se type constituted by a 0.3μ film of selenium and a 2μ film of polyvinyl carbasole successively deposited on a conductive base, and the light source employed for exposure purposes is a halogen lamp with a color temperature of 3000° K, the spectroscopic sensitivity of the PVK·Se photosensitive medium is as indicated by the curve (i) of FIG. 2, while wavelength characteristics of light emitted by the halogen lamp are as indicated by the curve (ii) of FIG. 3, and, since the PVK·Se photosensitive medium and the halogen lamp are used together in the same photocopying machine, the relative sensitivity of the photosensitive medium is as indicated by the curve (iii) of FIG. 4, which is obtained by multiplying successive values of the curve (i) of FIG. 2 by corresponding values of the curve (ii) of FIG. 3. In order to bring the curve (iii) of FIG. 4 close to relative visual sensitivity, i.e., in order to make the sensitivity of the photosensitive medium effectively close to that of the human eye, as shown by the dotted lines of FIG. 4, the exposure system suitably includes a filter which prevents passage of radiation of short wavelength, for example, a filter manufactured by Sumitomo Chemical Industries, Ltd. Japan which filters out radiation of light having a nominal wavelength of 550 mμ or less. The resulting sensitivity curve when such a filter is included in the exposure system is the curve (iv). Conventionally, however, no such a filter is provided in the arrangement for erasure of charge from non-image carrying portions of the photosensitive medium, with the result that, although problems of excessive use of toner particles and of removal of excess toner particles may be avoided, different portions of the photosensitive medium are regularly exposed to different types of radiation, and the sensitivity curve for portions F2 (FIG. 1) of the photosensitive medium which are always exposed to the same type of radiation is as indicated by the curve (iv) of FIG. 4 and that of photosensitive medium portions having the width e3 (FIG. 1) being as indicated by the curve (iii), thus resulting in variation of image density in these different portions after use of the photocopying machine for a certain period of time.

This problem is not limited to a photocopying machine which permits production of photocopies at varying magnifications, but also occurs in photocopying machines in which photocopy paper of varying sizes is employed. The photosensitive medium portions having widths d1 and d2 (FIG. 1) between image-carrying portions also are of course exposed to different types of radiation at different times, but as the photosensitive medium is moved during use of the photocopying machine, a portion of the non-latent image carrying portions having widths d1 and d2 which is not exposed to image light from an original document in one exposure process is used as an image-forming portion of the photosensitive medium in a later exposure process, whereby the effects of different kinds of radiation are cancelled.

In conventional arrangements, it is sometimes also the practice to make the lamp means used for erasure of charge from non-image carrying portions different from the lamp means used for exposure purposes. When, for example, the non-image carrying portion charge erasure lamp is a tungsten lamp with a color temperature of 2,800° K., the relevant characteristic curve is as indicated by a curve (v) of FIG. 3. In this case, the overall sensitivity curve of a PVK·Se photosensitive medium is slightly lower than the curve (iii) of FIG. 4, and spreads in the short wavelength regions, but it is still different from the curve (iv), and consequently the result is still that difference of density in images produced on different portions of the photosensitive medium occurs.

SUMMARY OF THE INVENTION

It is accordingly an object of the invention to provide an electrical charge erasing arrangement for use in a photocopying machine which effectively erases charge from portions of a photosensitive medium which are not required for production of images, whereby adhesion of toner particles to these portions is avoided.

It is another important object of the present invention to provide an electrical charge erasing arrangement of the above described type which ensures that photosensitive characteristics of different portions of a photosensitive medium are maintained generally the same during prolonged use of the photosensitive medium for elimination of uneven density in the copied images.

It is a further object of the present invention to provide an electrical charge erasing arrangement of the above described type which functions accurately and has a simple construction and can be readily incorporated into various types of photocopying machines.

In accomplishing these and other objects, there is provided, according to the present invention, an electrical charge erasing arrangement for erasure of charge from non-image portions of a photosensitive medium comprising erasure lamp means which are actuated, in response to actuation of external switch means or of automatically actuated switch means provided in a photocopying machine for removing charge from side portions of the photosensitive medium and intermediate portions of the image area which are not required to carry an image in a particular photocopying process, whereby undesired adhesion of toner is prevented, and filter means through which light from the erasure lamp means is passed prior to impingement thereof onto the photosensitive medium, and which is so selected that the range of wavelengths of radiation to which non-image portions of the photosensitive medium are exposed in order to remove charge therefrom is generally equal to that of radiation to which image portions of the photosensitive medium are exposed for the purpose of production of an image, whereby characteristics of different portions of the photosensitive medium are maintained the same and production of photocopies of even image density is achieved during prolonged use of the photosensitive medium.

BRIEF DESCRIPTION OF THE DRAWING

A better understanding of the present invention may be had from the following full description of several preferred embodiments thereof when read in reference to the attached drawings in which like numerals indicate like parts.

DETAILED DESCRIPTION OF THE INVENTION

Figure 5:
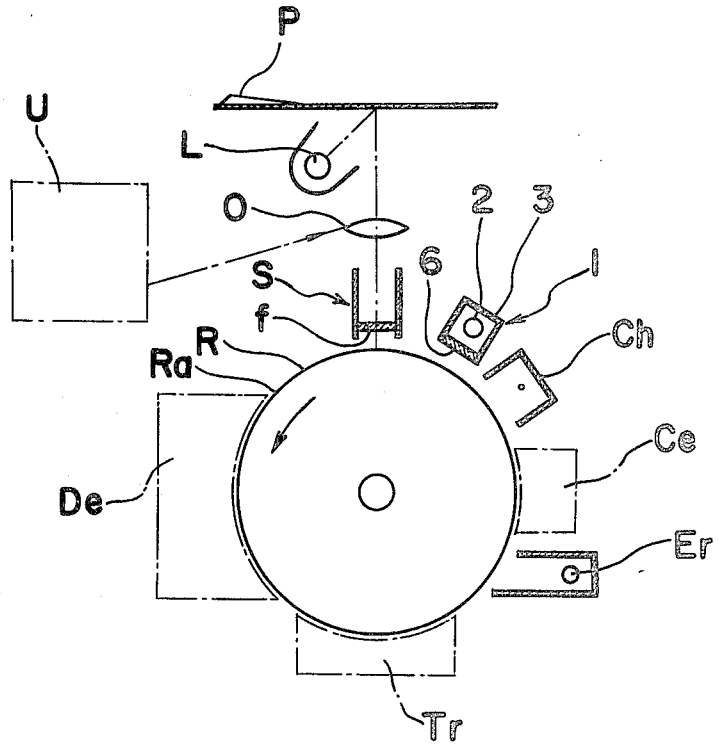
FIG. 5 is a schematic side sectional view of a photocopying machine for explaining the functioning of the electrical charge erasing arrangement according to the present invention.

Referring to FIG. 5, there is shown a photosensitive medium in the form of a drum R, which is rotatable, by drive means not shown, counterclockwise as seen in the drawing, to bring a peripheral surface Ra of the photosensitive medium successively past a corona charging unit Ch, which imposes a generally uniform electric charge on the peripheral surface Ra of the drum R, and a charge erasing arrangement 1, which serves to selectively remove charge from portions of the drum R which are not required for production of an image of an original document P, and which is described in greater detail later. The charged portions of the drum surface Ra are then brought into line with an exposure system comprising lamp means L for illumination of the document P, which is supported on an upper wall portion of the photocopying machine, and lens and mirror system O, which serves to direct light reflected from the original document P as a focused image through an exposure slit S, in which there is provided a filter f for cutting out short wave radiation having a wavelength of 520 mμ or less, and onto the photosensitive drum Ra, whereby an electrostatic latent image of the original document P is formed on the drum surface Ra. The exposure system may be of any conventionally known type, and if the photocopying machine is a machine for production of photocopies at various magnifications, the exposure system suitably includes changeover means, schematically indicated as a chain line block U in the drawing, which serves to adjust the position of the lens in the lens and mirror system O and the length of the focal path from the document P to the drum R, and also, if the exposure system is a scanning exposure system, to adjust the speed of scanning elements thereof, in accordance with requirements for obtaining photocopies of particular sizes. After passing the location of the exposure system, peripheral surface Ra of the drum R, now carrying an electrostatic latent image of the content of the original document P is moved past a development unit De whereat toner is applied on the drum surface Ra by a known process to develop the original document image, past a transfer unit Tr whereat the original document image is transferred onto copy paper in a known manner, past an erasure unit Er which removes charge from the entire surface of the drum, and past a cleaning unit Cl which removes remnant toner particles from the drum surface Ra, after which the drum peripheral portions are again brought to the location of the charging unit Ch.

Figure 6:
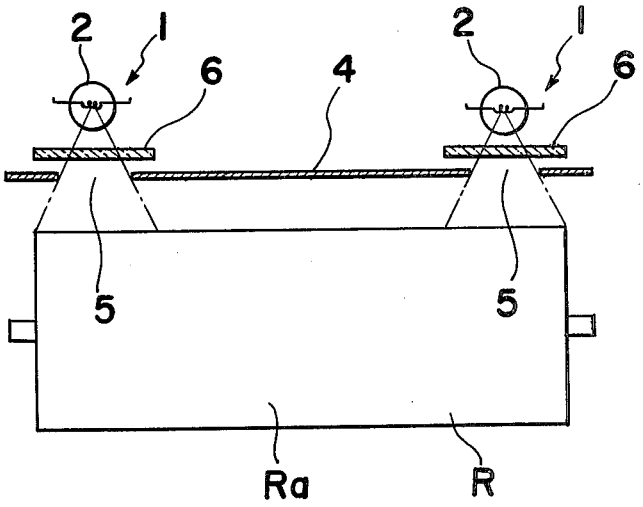
FIGS. 6 and 7 are respectively side sectional and perspective views showing the construction of the electrical charge erasing arrangement according to the present invention.
Figure 7:
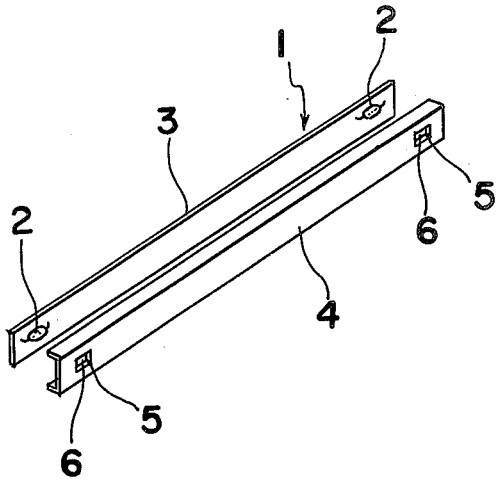

As shown in greater detail in FIGS. 6 and 7, the charge erasing arrangement 1 comprises light sources 2 which are supported by opposite end portions of a support frame 3, and a mask 4 which is provided between the frame 3 and the photosensitive drum R, and which has defined in opposite end portions thereof openings 5 which are positioned opposite the light sources 2 and through which light from the light sources 2 and can pass to impinge on the drum surface Ra, light from the light sources 2 being otherwise prevented by the mask 4 from impinging on the drum surface Ra, and the openings 5 being so positioned with respect to the drum R that light from the light sources 2 impinges on side portions of the peripheral surface Ra of the drum R which are sometimes not required for production of an image, either because smaller size copying paper is used for a particular photocopying process, or because a photocopy at reduced magnification is produced. Actuation of the light sources 2 may be controlled by switch means (not shown) provided in the photocopying machine for detection of copy paper of different sizes or by external switch means (not shown) for causing the photocopying machine to produce reduced-size photocopies, and when actuated the light sources are actuated simultaneously with the corona charging unit Ch.

Figure 1:
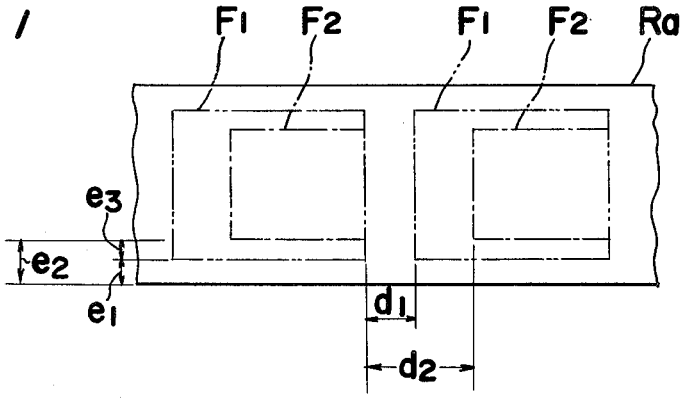
FIG. 1 is a top plan view of a known photosensitive medium shown as a flat element for use in explaining dispositions of images formed thereon (already referred to)
Figure 2:
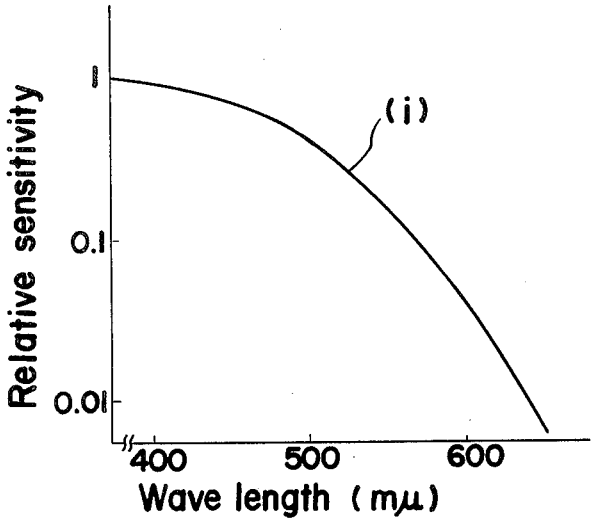
FIGS. 2, 3 and 4 are graphs showing characteristics of a photosensitive medium referred to above.
Figure 3:
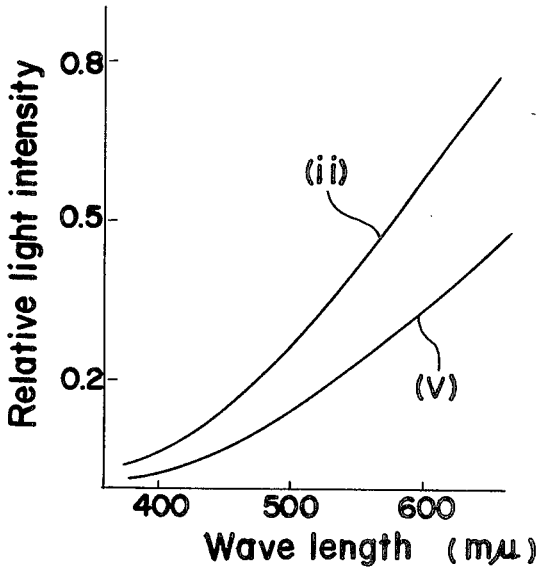
Figure 4:
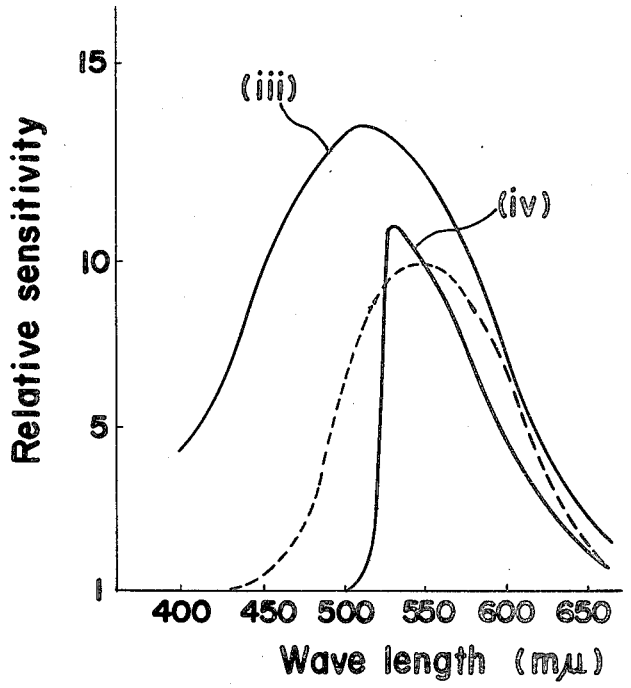

Before passing through the corresponding opening 5, light from a light source 2 passes through a filter 6, which is supported between the frame 3 and the mask 4, or actually in the corresponding opening 5, and which is so selected that the range of wavelengths of light reaching the drum portions having the width e3 or width e2 (FIG. 1) upon actuation of the light sources 2 is the same as or close to that of the light which is directed onto the drum R by the exposure system. In the above-described arrangement of the invention, this is achieved by employing tungsten lamps with a color temperature of 2,500° K. as the light sources 2 and filters which cut out radiation of 550 mμ or less as the filters 6. In other words, the arrangement 1 ensures removal of undesired charge from side portions of the peripheral surface Ra of the drum R, thus avoiding problems associated with use of excessive toner, and this erasure of charge is effected by radiation which is effectively the same as that to which the surface Ra of the drum R is exposed by the exposure system. Because charge erasure is effected in this manner, characteristics of the portions F2 and the side portions having the width e3 of the photosensitive drum surface Ra remain effectively the same and even image-quality of photocopies is achieved, regardless of the size of copy paper employed or the magnification of the photocopies.

The effectiveness of the charge erasing arrangement 1 was confirmed by tests in which, by the use of an entirely black original document, 100 and 500 photocopies were produced at a reduced magnification, with subsequent production of the same number of photocopies at equal magnification, with the result that there was no uneven density noticeable due to difference in sensitivity characteristics between the image-carrying portions and non-image carrying portions of the photosensitive medium.

Figure 8:
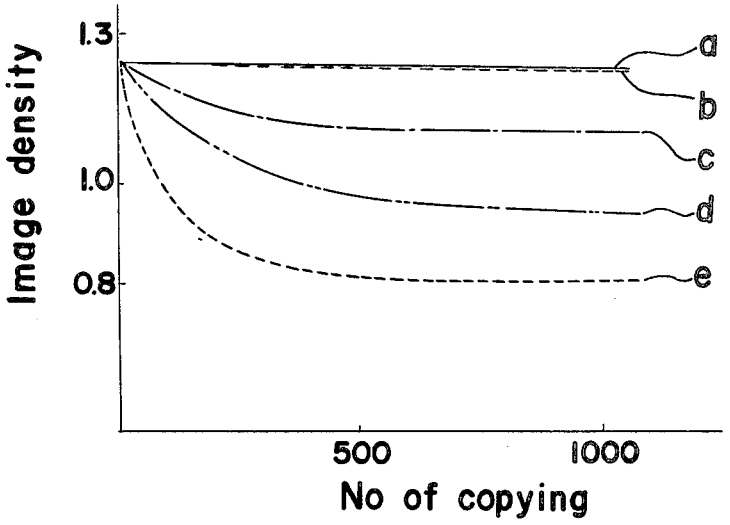
FIG. 8 is a graph showing results of tests of image density achieved in the photocopying machine employing the electrical charge erasing arrangement according to the invention.

Subsequently, in the arrangement as described above, comparative tests were carried out with and without various types of filters in the charge erasing arrangement 1, the procedure in each test being to produce photocopies using only portions F2 (FIG. 1) of the photosensitive drum R, and then produce photocopies using the drum portions F1 (FIG. 1) and compare the results achieved, this procedure being effected first employing the arrangement 1 provided with particular filters, and then employing the arrangement 1 but without filters. The results of these tests are plotted in the graph of FIG. 8, in which the curves a, b, c and d respectively show the variation of image density of photocopy portions corresponding to the drum portions having the width e3 with the increase of the number of photocopies produced using only drum portions F2 when filters for filtering out light in the wavelength ranges of 600 mμ, 520 mμ, 500 mμ and 460 mμ or less are employed in the charge erasing arrangement 1. The curve e shows the results achieved when no filters are employed in the arrangement 1. In the graph, the density indicated as being achieved after no photocopies have been taken is the density achieved after the photosensitive drum is allowed to recover naturally in a dark location. As seen from the curves a and b, when filters for filtering out of wavelength ranges of 600 mμ and 520 mμ or less are employed, there is hardly any variation of density in the photocopy portions corresponding to the drum portions F2 and the side portions having the widths e3 even after production of a large number of photocopies. On the other hand, there is a marked difference in density when no filters are employed. Also, as indicated by the curve d, if the filters employed filter out only light in the very short wavelength range, although the results are slightly better than when no filters are employed, there is a considerable decrease in density of the side portions having the width e3 as the number of photocopies increases. In other words, the filters employed in the arrangement 1 must be selected carefully with reference to the characteristics of the photosensitive surface Ra of the drum R. Needless to say, depending on the type of photosensitive medium employed, the filters may be filters which filter out long wavelength radiation. Also, if the light sources employed in the arrangement 1 are the same as the light source in the exposure system, the filters employed in the arrangement 1 may be the same as the filter or filters employed in the exposure system.

Figure 9:
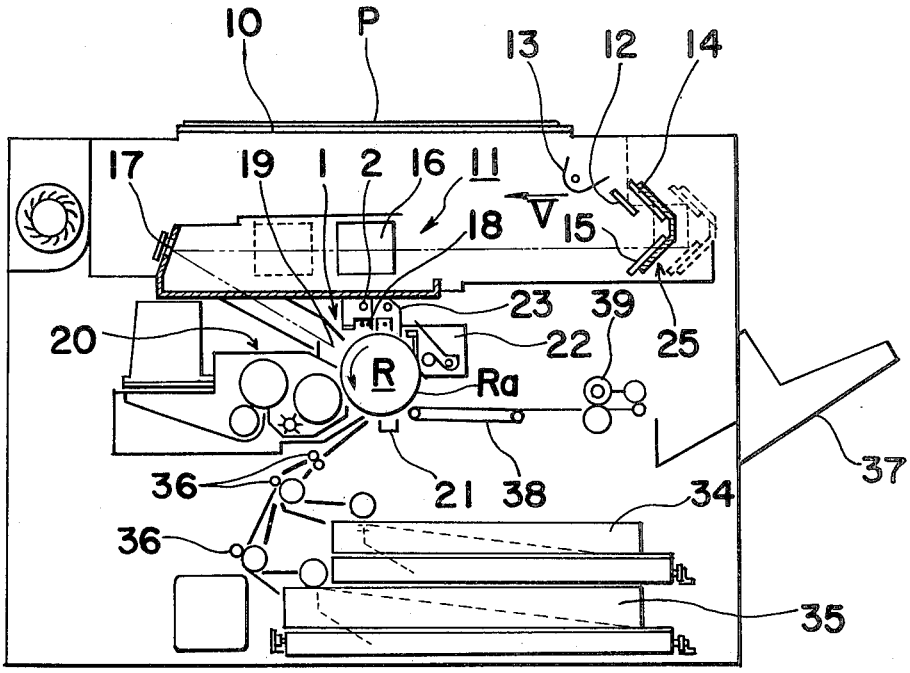
FIG. 9 is a schematic side sectional view of a photocopying machine in which the electrical charge erasing arrangement according to the present invention is incorporated.
Figure 10:
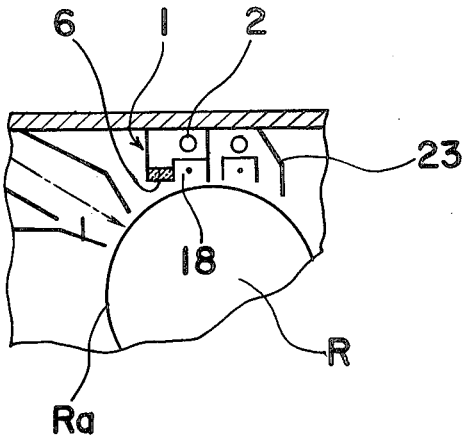
FIG. 10 is a fragmentary side sectional view showing, on an enlarged scale, the disposition of the electrical charge erasing arrangement of FIG. 9.
Figure 11:
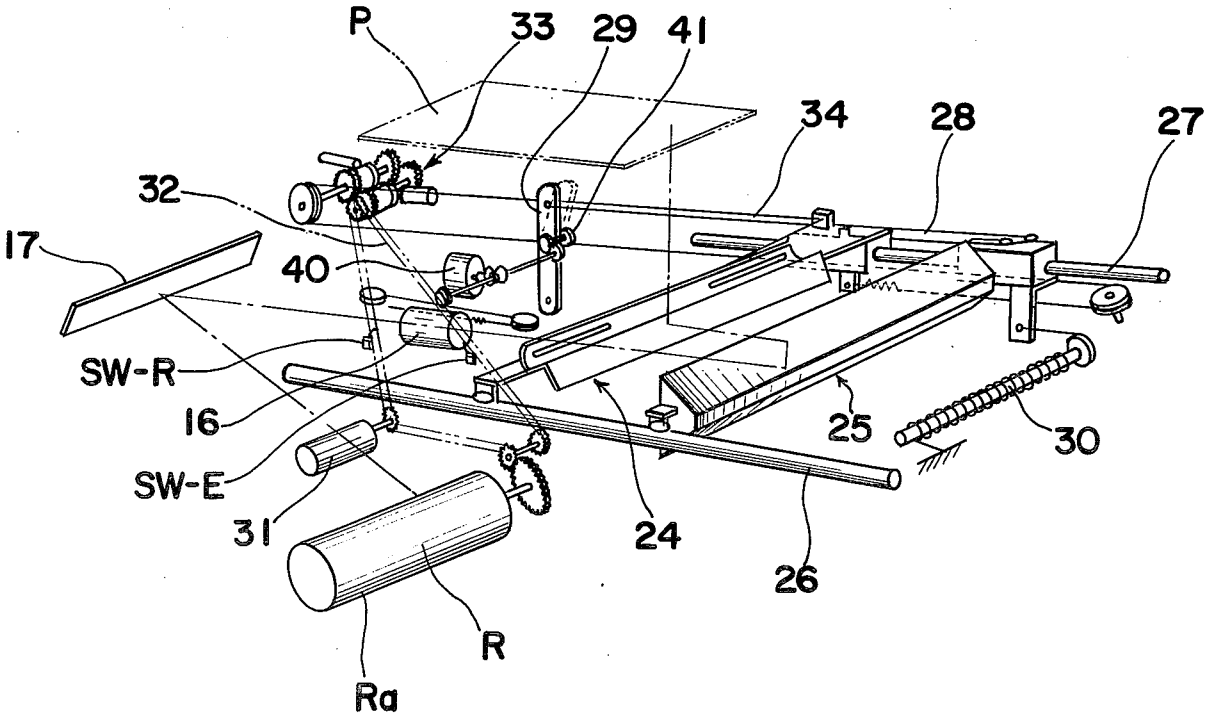
FIG. 11 is a perspective view showing, on an enlarged scale, the structure of the optical system of the copying machine of FIG. 9.

Referring now to FIGS. 9 to 11, there is shown in FIG. 9 a photocopying machine of the variable magnification type which is disclosed in greater detail in a co-pending U.S. patent application Ser. No. 885,015 filed on Mar. 9, 1978, under the title of "Photocopying machine equipped with variable magnification arrangement" and assigned to the same assignee as the present application, and in which the unrequired charge erasing arrangement of the present invention is incorporated.

The photocopying machine of FIG. 9 generally includes, on the upper wall portion thereof, a horizontally disposed transparent document rest 10 for support of the original document P to be copied, image light from which may be directed by an optical system 11 onto a photosensitive drum R having a photosensitive surface Ra and located in a generally central portion of the photocopying machine. The optical system 11 further includes a first mirror 12 and a light source 13 which are moved together at a speed V in the direction indicated by the arrow in the drawing, in order to scan successive portions of the documents P on the support 10, a second mirror 14 and a third mirror 15, which are moved in the same direction at a speed ½ V, and a lens assembly 16 and a fourth mirror 17, which are fixed, the photosensitive drum R being rotated, during scanning of the document P, counterclockwise as seen in the drawing, and image light from successively scanned portions of the document P being directed onto successive portions of the peripheral surface Ra of the drum R by the optical system 11.

As the drum R rotates, the portions of the peripheral surface Ra thereof are successively brought past a corona charging unit 18, an exposure station 19, whereat image-wise light from the document P is directed onto the surface of the drum R by the optical system 11, a dry-type developer unit 20, which directs onto exposed portions on the surface of the drum R, charged toner particles which adhere to the drum surface Ra in an image-defining pattern, a transfer station whereat there is provided a transfer charger 21 and the toner particles are transferred onto copy paper (not shown) brought into contact with the surface Ra of the drum R and a cleaning unit 22 and an erasing unit 23 which respectively clean off remnant toner particles and remove remnant electrical charge from the drum surface Ra, with the charge erasing arrangement 1 directly related to the present invention being located in a position above and adjacent to the corona charging unit 18 as most clearly seen in FIG. 10.

The photocopying machine as described above permits photocopies of different magnifications to be produced and copy paper of requisite size to be selected for photocopies of particular magnifications, and in FIG. 11, the exposure system thereof comprises a first scanning system 24 and a second scanning system 25 which are movable at variable speeds but at constant relative speed, and which direct image light from successive portions of a document P via the focussing lens 16 and fixed mirror 17 onto successive portions of the photosensitive drum R, the focusing lens 16 being movable to different positions and the second scanning system 25 being movable to different positions relative to the first scanning system 24 in order to change the optical path length to the drum R in accordance with the required magnification of a photocopy. The first scanning system 24 and the second scanning system 25 are both slidably mounted on guide rails 26 and 27. The second scanning system is connected by a wire 28 to the first scanning system 24 and to a positioning lever 29, and is also connected to a spring return means 30, which exerts a constant force to return the scanning systems 24 and 25 to initial positions, rightwards as seen in FIG. 11. The first scanning system 24 and hence the second scanning system 25 are driven by a motor 31 acting through a chain 32, and a speed-change clutch means 33, shown in the upper portion of FIG. 11, and a wire 34 connecting the clutch means 33 to the first scanning system 24. The motor 31 also supplies direct drive to the photosensitive drum R. The speed transmission ratio of the clutch means 33 is altered in response to actuation of switch means by cassettes 34 and 35 which are shown in the lower portion of FIG. 9, and contain copy paper of different sizes, and of externally actuable switch means for causing production of photocopies of a particular magnification and selection of copy paper from either the cassette 34 or the cassette 35, selected copy paper being transported to the transfer unit 21 by a transport system 36 and then forwarded to an external tray 37 by forwarding means 38 and heating means 39. The above-mentioned externally actuable switch means also causes actuation of a motor 40, which, acting through gears and other suitable drive transmission means, causes the lens 16 to move to a right-hand or left-hand position as seen in FIG. 11 and cause rotation of a cam 41, which contacts the above-mentioned positioning lever 29 connected to the second scanning system 25. When photocopies having a size equal to that of the original document are required, the cam 41 causes the lever 29 to move the second scanning system 25 closer to the first scanning system 24, and the lens 16 is moved to the right-hand position and upon reaching this position actuates a switch SW-E causing the motor 40 to stop. When photocopies of reduced magnification are required, the cam 41 causes the lever 29 to move to a position in which the spring return means 30 may move the second scanning system 25 further from the first scanning system 24, and the lens 16 is moved to the left-hand position and upon reaching this position actuates a switch SW-R causing the motor 40 to stop. Actuation of the switch SW-R also causes actuation of the light sources in the charge erasing arrangement 1 shown on a large scale in FIG. 10. Since the function, effect and construction of the charge erasing arrangement 1 have already been described in detail with reference to FIGS. 1 to 8, a detailed description thereof is omitted here for brevity.

As is clear from the foregoing description, according to the arrangement of the present invention, since it is so arranged that the non-image carrying portions on the photosensitive medium are subjected to light having a wavelength range approximately equal to that of the light for exposing the image carrying portions of the photosensitive member so as to effect erasing of electrical charge on such non-image carrying portions, not only is wasteful consumption of toner eliminated by preventing toner particles from adhering to the non-image carrying portions, with consequent reduction of load over on the residual toner cleaning device, but also the sensitivity characteristics of the intermediate non-image carrying portions between the image carrying portions and sensitivity characteristics of the side non-image carrying portions which are used as non-image carrying portions in the reduced magnification copying and which become image carrying portions during the equal magnification copying are maintained equal to the sensitivity characteristics of the image carrying portions, whereby uneven density at the latent image stage is advantageously eliminated and copied images of high quality can be provided.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. In a photocopying machine having a photosensitive medium, corona charging means for charging said photosensitive medium, exposure means including a light source for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, and development means for development of said electrostatic latent image, a charge erasing arrangement which is positioned between said corona charging means and said development means and directed toward said photosensitive medium and actuable to effect erasing of electrical charge from portions of said photosensitive medium which are not required for production of the electrostatic latent image, said charge erasing arrangement comprising;

housing means disposed between said corona charging means and said development means, charge erasing lamp means accommodated in said housing means, and filter means for wavelength range correction disposed between said charge erasing lamp means and said photosensitive medium for passing only light from said charge erasing lamp means in a range of wavelengths approximately equal to the range of wavelengths of said image light from said exposure means.

2. A charge erasing arrangement as claimed in claim 1, wherein said wavelength range correction filter means is a filter which filters out light in the short wavelength range.

3. In a photocopying machine having a photosensitive medium, corona charging means for charging said photosensitive medium, exposure means including a light source for illumination of an original document to be copied and an optical system for projection image light from the original document thus illuminated onto said photosensitive medium subsequent to charging thereof by said corona charging means in order to effect production of an electrostatic latent image of said original document on said photosensitive medium, and development means for development of said electrostatic latent image, a charge erasing arrangement which is positioned between said corona charging means and said development means and directed toward said photosensitive medium and actuable to effect erasing of electrical charge from portions of said photosensitive medium which are not required for production of the electrostatic latent image, said charge erasing arrangement comprising;

housing means disposed between said corona charging means and said development means, at least one set of charge erasing lamps accommodated in said housing for projecting light only onto said portions of said photosensitive medium which are not required for the production of the electrostatic latent image, and filter means for wavelength range correction disposed between said charge erasing lamps and said photosensitive medium for passing only light from said charge erasing lamps in a range of wavelengths approximately equal to the range of wavelengths of said image light from said exposure means.

4. In a photocopying machine having a photosensitive medium, corona charging means for charging said photosensitive medium exposure means including lamp means for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, development means for development of said electrostatic latent image on said photosensitive medium, and transfer means actuable to effect transfer of a developed image from said photosensitive means onto copying material, a charge erasing arrangement which is positioned between said corona charging means and said development means and directed toward said photosensitive medium and actuable to effect erasing of electrical charge from portions of said photosensitive medium which are not required for production of the electrostatic latent image, said charge erasing arrangement comprising;

charge erasing lamp means actuable to emit radiated light to effect removal of charge from said photosensitive medium;

light radiation guide means disposed to guide the radiated light from said charge erasing lamp means onto selected portions of said photosensitive medium and preventing exposure of other portions of said photosensitive medium to said radiated light from said charge erasing lamp means;

filter means through which said radiated light from said charge erasing lamp means passes before impingement thereof on said photosensitive medium and having filtering qualities such that the portion of the radiated light from said charge erasing lamp means which reaches said photosensitive medium is generally the same as the image light to which said photosensitive medium is exposed by said exposure means; and a power supply circuit connected to said charge lamp means and closeable to actuate said charge erasing lamp means.

5. A charge erasing arrangement as claimed in claim 4, wherein said filter means comprises means for filtering out light in the short-wave range.

6. In a variable magnification photocopying machine having a photosensitive medium, corona charging means for charging said photosensitive medium, exposure means including lamp means for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, development means for development of said electrostatic latent image on said photosensitive medium, transfer means actuable to effect transfer of a developed image from said photosensitive medium onto copying material, changeover means selectively movable to a first position to cause said photocopying machine to produce photocopies which are the same size as the original document and to a second position to cause said photocopying machine to produce reduced-size photocopies, a charge erasing arrangement which is positioned between said corona charging means and said development means and directed toward said photosensitive medium and actuable to effect removal of electrical charge from portions of said photosensitive medium which are not required for production of the electrostatic latent image, said charge erasing arrangement comprising;

charge erasing lamp means actuable to emit radiated light to effect removal of charge from said photosensitive medium;

light radiation guide means disposed to guide the radiated light from said charge erasing lamp means onto selected portions of said photosensitive medium and preventing exposure of other portions of said photosensitive medium to said radiated light;

filter means through which said radiated light from said charge erasing lamp means passes before impingement thereof on said photosensitive medium and having filtering qualities such that the portion of the radiated light from said charge erasing lamp means which reaches said photosensitive medium is generally the same as the image light to which said photosensitive medium is exposed by said exposure means; and a power supply circuit connected to said charge erasing lamps and closeable to actuate said charge erasing lamp means when said changeover means is moved to said second position.

7. In a photocopying machine having a photosensitive medium, corona charging means for charging said photosensitive medium, exposure means including a light source for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, a charge erasing arrangement directed toward said photosensitive medium and actuable to effect erasing of electrical charge from portions of said photosensitive medium which are unnecessary for production of the electrostatic latent image, said charge erasing arrangement comprising;

housing means;

charge erasing lamp means accommodated in said housing means, and filter means for wavelength range correction disposed between said charge erasing lamp means and said photosensitive medium for passing only light from said charge erasing lamp means in a range of wavelengths approximately equal to the range of wavelengths of said image light from said exposure means.

8. A charge erasing arrangement as claimed in claim 7, wherein said wavelength range correction filter means is a filter which filters out light in the short wavelength range.

9. In a photocopying machine having a photosensitive medium, corona charging means for charging said photosensitive medium, exposure means including a light source for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, a charge erasing arrangement directed toward said photosensitive medium and actuable to effect erasing of electrical charge from portions of said photosensitive medium which are unnecessary for production of the electrostatic latent image, said charge erasing arrangement comprising;

housing means;

at least one set of charge erasing lamps accommodated in said housing for projecting light only onto said portions of said photosensitive medium which are unnecessary for the production of the electrostatic latent image; and filter means for wavelength range correction disposed between said charge erasing lamps and said photosensitive medium for passing only light from said charge erasing lamps in a range of wavelengths approximately equal to the range of wavelengths of said image light from said exposure means.

10. In a photocopying machine having a photosensitive medium, corona charging means for charging said photosensitive medium exposure means including lamp means for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, and transfer means actuable to effect transfer of an image from said photosensitive means onto copying material, a charge erasing arrangement which is positioned between said corona charging means and said transfer means and located toward said photosensitive medium and actuable to effect erasing of electrical charge from portions of said photosensitive medium which are unnecessary for production of the electrostatic latent image, said charge erasing arrangement comprising;

charge erasing lamp means actuable to emit radiated light to effect removal of charge from said photosensitive medium;

light radiation guide means disposed to guide the radiated light from said charge erasing lamp means onto selected portions of said photosensitive medium and preventing exposure of other portions of said photosensitive medium to said radiated light from said charge erasing lamp means;

filter means through which said radiated light from said charge erasing lamp means passes before impingement thereof on said photosensitive medium and having filtering qualities such that the portion of the radiated light from said charge erasing lamp means which reaches said photosensitive medium has substantially the same wave-length characteristics as the image light to which said photosensitive medium is exposed by said exposure means; and a power supply circuit connected to said charge erasing lamp means and closeable to actuate said charge erasing lamp means.

11. A charge erasing arrangement as claimed in claim 10, wherein said filter means comprises means for filtering out light in the short-wave range.

12. In a variable magnification photocopying machine having a photosensitive medium, corona charging means for charging said photosensitive medium, exposure means including lamp means for illumination of an original document to be copied and an optical system for projecting image light from the original document thus illuminated onto said photosensitive medium subsequent to charging thereof by said corona charging means in order to effect production of an electrostatic latent image of said original document on said photosensitive medium, transfer means actuable to effect transfer of an image from said photosensitive medium onto copying material, and changeover means selectively movable from a first position to a second position to cause said photocopying machine to produce reduced-size photocopies, a charge erasing arrangement directed toward said photosensitive medium and actuable to effect removal of electrical charge from portions of said photosensitive medium which are unnecessary for production of the electrostatic latent image, said charge erasing arrangement comprising;

charge erasing lamp means actuable to emit radiation of light to effect removal of charge from said photosensitive medium;

light radiation guide means disposed to guide the radiated light from said charge erasing lamp means onto selected portions of said photosensitive medium and preventing exposure of other portions of said photosensitive medium to said radiated light;

filter means through which said radiated light from said charge erasing lamp means passes before impingement thereof on said photosensitive medium and having filtering qualities such that the portion of the radiated light from said charge erasing lamp means which reaches said photosensitive medium has substantially the same wave-length characteristics as the image light to which said photosensitive medium is exposed by said exposure means; and a power supply circuit connected to said charge erasing lamps and closeable to actuate said charge erasing lamp means when said changeover means is moved to said second position.

* * * * *